United States Patent [19]

Prieto et al.

[11] Patent Number: 4,766,411

[45] Date of Patent: Aug. 23, 1988

[54] USE OF COMPOSITIONALLY MODULATED MULTILAYER THIN FILMS AS RESISTIVE MATERIAL

[75] Inventors: Argenis R. Prieto; David P. Clark, both of Mineral Wells, Tex.

[73] Assignee: U.S. Philips Corporation, New York, N.Y.

[21] Appl. No.: 868,843

[22] Filed: May 29, 1986

[51] Int. Cl.[4] ..... H01C 1/012

[52] U.S. Cl. ..... 338/306; 338/314

[58] Field of Search ..... 338/306, 314, 320, 195, 338/9

[56] References Cited

U.S. PATENT DOCUMENTS 4,454,495 6/1984 Werner et al. ..... 338/195

*Primary Examiner*—E. A. Goldberg
*Assistant Examiner*—M. M. Lateef
*Attorney, Agent, or Firm*—Ernestine C. Bartlett

[57] ABSTRACT

A compositionally modulated multilayer thin film material system for use as a resistive material in metal film resistors wherein at least two different metallic compositions having good resistive properties are deposited alternately in thin film layers on a substrate, the resulting film having improved TCR & TCR Slope characteristics.

10 Claims, 3 Drawing Sheets

LAYERED FILM SYSTEM
COMPRISING n LAYERS
(A : B RATIO = CONSTANT)

LAYERED FILM SYSTEM
COMPRISING n LAYERS
(A : B RATIO = CONSTANT)

USE OF COMPOSITIONALLY MODULATED MULTILAYER THIN FILMS AS RESISTIVE MATERIAL

BACKGROUND OF THE INVENTION

1. Field of the Invention

The invention pertains to metal film resistors and in particular to resistors having two or more layers of a metallic film deposited on an insulative substrate, wherein at least two different metallic compositions are utilized alternately in the sequence of layers. Alternating metallic compositions in the layered resistive film structure provides a technique for controlling the TCR Slope of the resistor.

2. Description of the Prior Art

Metal film resistors are typically made by single target sputtering of a metallic alloy composition on an insulative substrate and subjecting the resulting system to a heat treatment in air at approximately 300° C. Typically either a ceramic core or a ceramic chip is utilized as the substrate. The resistive films used are typically alloys of nickel and chrome with some other metals used in lesser percentages. Sputtered or evaported NiCr alloys are widely used as deposited resistive film.

The desired TCR is obtained by heat treating the resistive film. The range of time and temperature for the heat treatment is usually a function of the desired temperature coefficient of resistance (TCR) of the resistor. During the heat treatment there is crystalline growth in the bulk of the resistive film applied to the substrate; the larger the crystallites, the more positive the TCR will be. However, during heat treatment crystals on the surface of the metal film break down and surface oxidation takes place, causing the TCR to be less positive in that area. With the addition of a heat treatment to the process of making resistors, the net effect is that for most resistors the TCR will be more positive because crystal growth is promoted in the bulk of the metal film. To prevent the TCR from becoming too positive, contaminants can be introduced into the sputtering process, and/or reactive sputtering can be used concurrently. However, only TCR is controlled thereby, not TCR Slope.

One problem with prior art metal film systems for resistor applications is that the TCR Slope cannot be controlled. Controlling the TCR Slope enables one to produce a resistor whose operation is more independent of temperature and is therefore more stable. Ideally, a TCR of 0 (zero) and a TCR Slope of 0 (zero) is desirable. To control the TCR Slope and thereby obtain a TCR approaching 0 (zero) over a wide temperature range, a layering of metallic films of differing material composition has been found to be effective. The present invention is directed to a compositionally modulated thin metal film system in which the TCR Slope can also be controlled.

SUMMARY OF THE INVENTION

The principal object of the present invention is to provide a resistive film with the desired sheet resistivity (ohms per square), temperature coefficient of resistance (TCR) (the first derivative of resistance with respect to temperature divided by the value of the resistance), and temperature coefficient of resistance slope (TCR Slope) (the second derivative of resistance with respect to temperature divided by the value of the resistance).

A second object of this invention is to provide a layered resistive film system which has a higher TCR value than its compositionally alloyed equivalent, thus providing a well-controlled mechanism to increase the TCR of the multilayered resistive film while also lowering its TCR Slope.

These objects are achieved by the use of compositionally modulated multilayer thin films as resistive material. A multilayer thin resistive film is made by depositing alternately multiple thin layers of two resistive films of differing material composition, such as a layer of NiV and a layer of Cr, on an insulative substrate, such as a ceramic cylinder, by a vacuum deposition technique such as sputtering. The TCR of each layer can be adjusted by alloy composition, film thickness, reactive deposition with a gas, and/or heat treatment variations of both time and temperature. The deposited multilayer resistive film is then subjected to a heat treatment in air, wherein the heat treatment ranges from 290° C. to 350° C. to obtain a TCR of 0 (zero). This multilayer resistive film will also show a decrease in the value of the TCR slope. Both TCR and TCR Slope can be adjusted by alternating layers of metallic films of different compositions, which differing compositions may also have differing TCR's. The TCR and resistivity of each layer can be adjusted through feedback to yield the desired results for a specific resistor requirement. A TCR and a TCR Slope of 0 (zero) are desirable for a stable resistor.

DESCRIPTION OF THE PREFERRED EMBODIMENT

Figure 3:
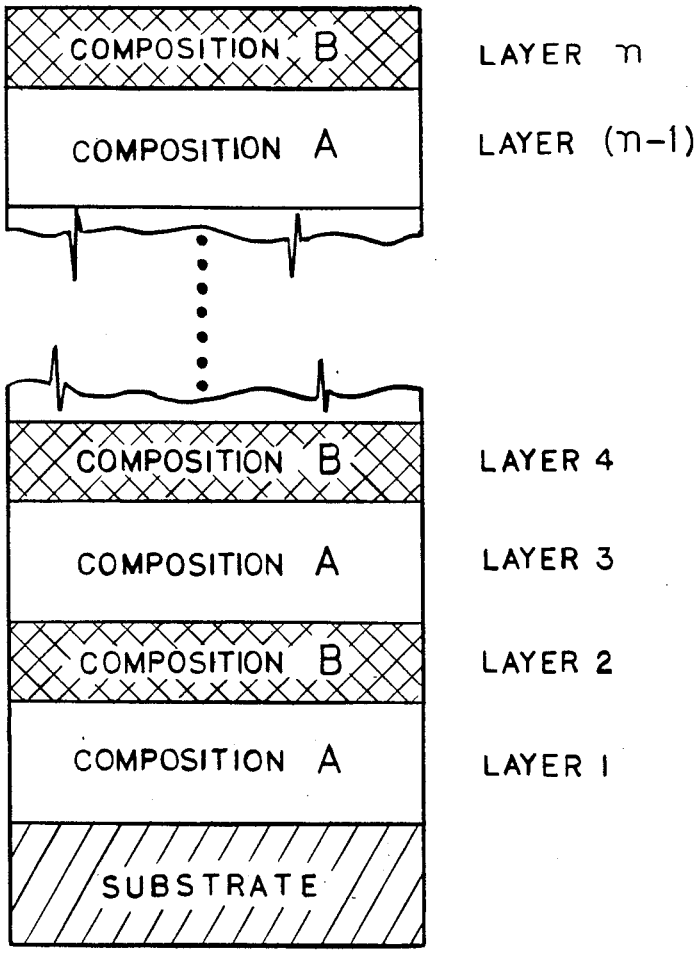
FIG. 3 is a partially broken away cross-section of a resistor according to the invention.

The present invention is a compositionally modulated multilayer thin film resistive material system which provides a well-controlled mechanism to increase the TCR of a resistive film while also lowering its TCR Slope. It also provides a resistive film having the desired sheet resistivity (ohms per sq.), temperature coefficient of resistance (TCR) (the first derivative of resistance with respect to temperature divided by the value of the resistance), and the temperature coefficient of resistance slope (TCR Slope) (the second derivative of resistance with respect to temperature divided by the value of the resistance). The compositionally modulated multilayer resistive film system uses a less steep angle in heat treatment to reach a TCR of 0 (zero), thereby providing a larger window to reach a TCR of 0 (zero). The resistive material composition system of the present system provides control of the TCR Slope of the resistive film by having the film in a layered structure, each layer having a material composition differing from the two adjacent layers. Typically, in a prior art resistive film, a resistive material comprising a metal or an alloy is sputtered on an insulative substrate typically of ceramic, until a desired thickness is reached. In the system of the present invention, as shown in FIG. 3, a thin layer of a first resistive film (Composition A) is applied to a substrate by a vacuum deposition technique such as sputtering. Then a second thin layer of a second resistive film (Composition B) having a material composition differing from the first resistive film is applied over the first layer. If additional layers are needed to satisfy the desired electrical characteristics for the resistive film, a third thin layer may be applied, using the first resistive film. Likewise, a fourth layer could be applied using the second resistive film. More layers could be deposited if so desired. At the minimum a layered resistive film requires at least two layers, and at least two resistive films differing in material composition. Adjacent layers cannot have the same material composition.

Figure 2:
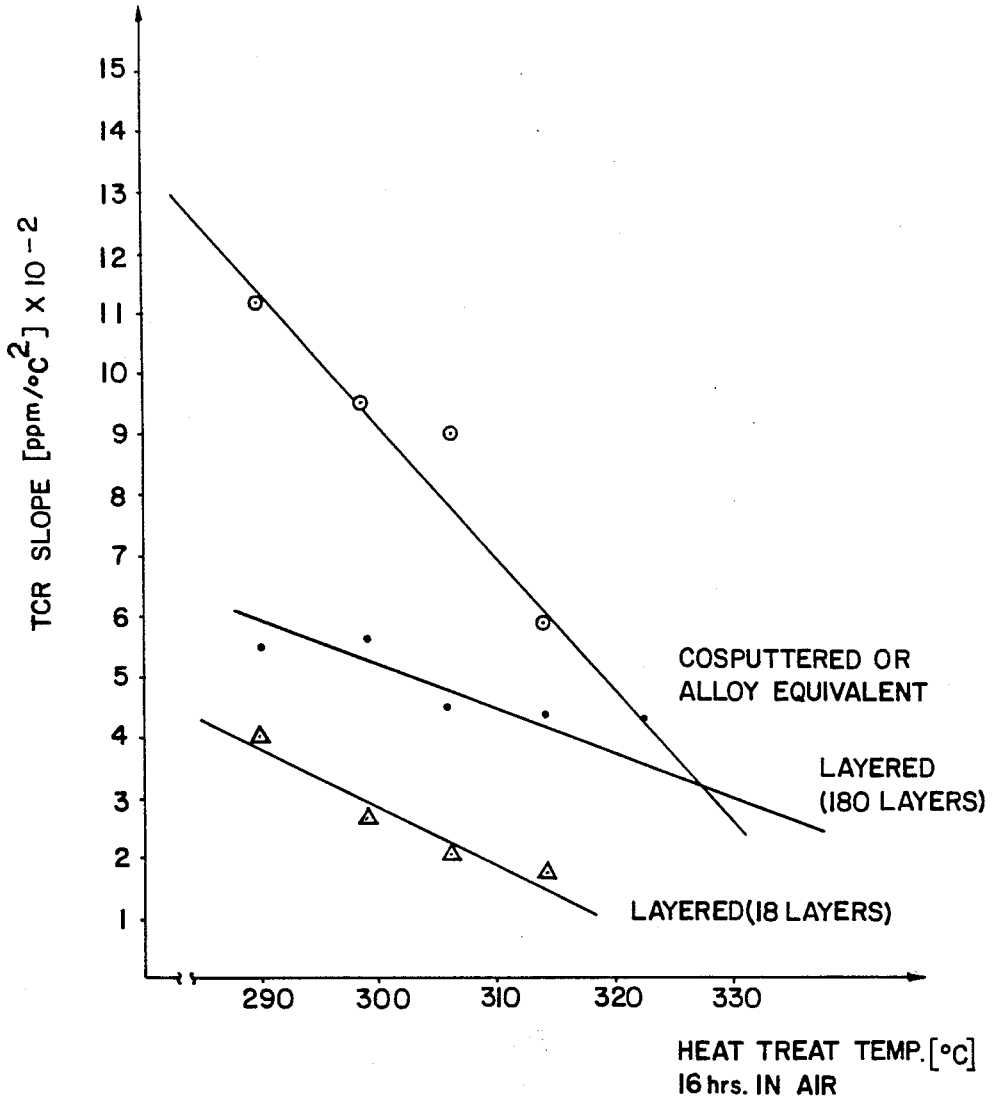
FIG. 2 is a graph showing the TCR Slope plotted against heat treatment temperature for a prior art resistor and a resistor using the compositionally modulated multilayer resistive film system of the present invention.

In the preferred embodiment, thin layers of resistive films are applied alternately to an insulative ceramic substrate such as a ceramic core or a ceramic chip, using a vacuum deposition technique such as sputtering. The TCR of each layer can be adjusted by conventional means such as alloy composition, film thickness, reactive deposition with a gas, and/or heat treatment variations of time and temperature. After heat treatment, a layered resistive film shows a higher TCR than its compositionally alloyed equivalent, thus providing a well-controlled mechanism to increase the TCR while also lowering the TCR Slope. The TCR Slope $$\frac{1}{R}\ \frac{d^2R(T)}{dT^2},$$

shows a significant lowering in the examples of layered films plotted in FIG. 2.

As an example of the present invention, a thin layer of a first resistive material such as NiV is deposited on an insulative substrate such as a ceramic core by a vacuum deposition technique such as sputtering. Then a second thin layer of a second resistive material, such as Cr is deposited over and coextensive with the first layer. While at least two different metallic compositions and at least two layers are the minimal necessary for a multilayered structure, for most resistor applications a plurality of layers is necessary. In this embodiment, repeated alternate layers of NiV and Cr are deposited on the ceramic core. The permissible variations in material composition for this embodiment using $Ni_xV_y$ and $Cr_z$, where the subindices indicate atomic percent and $x+y+z=100$ are $$20<x<80$$

$$5<y<12$$

$$25<z<90$$

Other widely used resistive materials may also be used.

The desired TCR for a given multilayer resistive film is attained by heat treatment air. For the embodiment specified above, the temperature range for the heat treatment in air is from 290° C. to 350° C. to obtain a TCR near 0 (zero).

Figure 1:
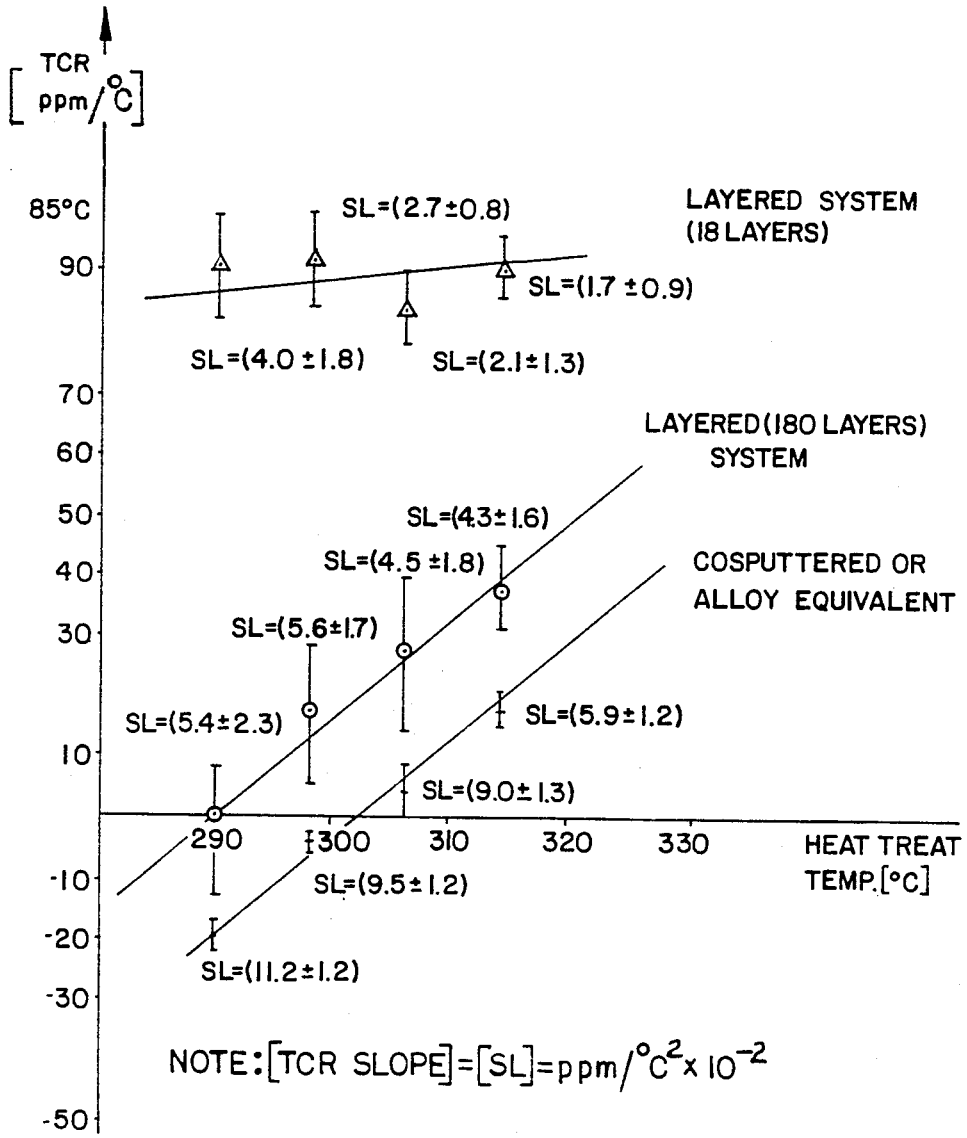
FIG. 1 is a graph which plots the TCR vs. the heat treatment temperature for three resistive film systems, two of which incorporate the compositionally modulated multilayer resistive film system of the present invention.

The results for the embodiment just described are illustrated in FIG. 1, in which they are compared with a prior art homogeneous material composition. FIG. 1 is a graph showing plots of TCR vs. heat treatment temperatures for two multilayer resistive films and one homogeneous alloy. For all three films, the film thickness and composition ($Ni_xV_yCr_z$) are the same.

In FIG. 1, the layered system with 18 layers and the layered system with 180 layers differ only in the thickness of the individual layers. The total thickness of each multilayered film is the same. In each case, the TCR is higher than the TCR for a cosputtered or alloy equivalent film. However, the 18 layered system shows greater improvement in TCR over a wider range of heat treatment temperatures. The reason is that the thicker layers allow for greater crystalline growth. Also the slope of heat treatment temperature to reach a given TCR is far less steep than for the 180 thin layer system or for the alloy film. Hence, in the 18 layer system, the heat treatment temperature is less critical. Thus, a larger window in the range of heat treatment temperatures is obtained to reach a TCR of 0 (zero).

Also for each plotted point in FIG. 1, the TCR Slope (SL) is calculated. At each point with a layered system, there is an increase in the TCR and a decrease in the TCR Slope, $$\frac{1}{R}\ \frac{d^2R(T)}{dT^2}.$$

This data is plotted on FIG. 2 also, and both Figures show that a compositionally modulated thin film system used as a resistive material has a higher TCR value than its alloyed equivalent and that it provides a well-controlled mechanism to increase TCR while decreasing TCR Slope.

There exists a wide range of known resistance elements which may be utilized in the compositionally modulated multilayer thin film system.

This film system offers the advantage of being able to adjust the TCR and the TCR Slope to a value of near (zero). In prior art material systems, it was either difficult or impossible to adjust both TCR and TCR Slope to a value near 0 (zero).

What is claimed is:

1. A multilayer metal film resistor having an improved TCR and an improved and controllable TCR Slope, wherein said TCR and TCR Slope both approach zero, comprising:

an insulative substrate suitable for deposition of a metallic film;

a first layer of a first metallic composition, said first layer formed by deposition of said first metallic composition on said substrate and heating said deposition in air at a temperature ranging from 290° C. to 350° C. for a period of time sufficient to effect a desired TCR;

a second layer of a second metallic composition, said second layer formed by deposition of said second composition on and coextensive with said first composition and heating said layers in air at temperatures ranging from 290° C. to 350° C. for a period of time sufficient to effect a desired TCR for said two layers;

wherein said first and second metallic compositions are different compositions; and wherein said TCR Slope approaches zero as said TCR approaches zero.

2. The resistor of claim 1 wherein said resistor further includes a plurality of additional layers and no two adjacent layers of resistive film have the same material composition.

3. The resistor of claim 1 or 2 wherein said first metallic composition is NiV and said second metallic composition is Cr.

4. The resistor of claim 1 or 2 wherein said first metallic composition is $Ni_xV_y$ and said second metallic composition is $Cr_z$ where x, y and z indicate atomic percent and $x+y+z=100$ and $20<x<80$ $5<y<12$ and $25<z<90$ 5. The resistor of claim 2 wherein said plurality of additional layers have the same metallic compositions as said first and second layers.

6. The resistor of claim 1 or 2 wherein said plurality of additional layers ranges from two to one hundred seventy-eight.

7. The resistor of claim 1 wherein said first metallic composition has a TCR and a TCR Slope differing from the TCR and TCR Slope of said second metallic composition.

8. A multilayer metal film resistor having an improved TCR and an improved and controllable TCR Slope, wherein said TCR and TCR Slope both approach zero, comprising:

an insulative substrate suitable for deposition of a metallic film;

at least one layer of a NiV metallic composition formed by deposition on said substrate followed by heating to a temperature of 290° C.–350° C. for a period sufficient to effect a desired TCR;

at least one layer of a Cr metallic composition formed by deposition on said NiV layer and heating to a temperature of 290° C.–350° C. for a period sufficient to effect a desired TCR;

and wherein no two adjacent layers of metallic compositions are the same.

9. A multilayer metal film resistor having an improved TCR and an improved and controllable TCR Slope, wherein said TCR and TCR Slope both approach zero, comprising:

an insulative substrate suitable for deposition of a metallic film;

at least a first layer of a $Ni_xVy$ metallic composition; and at least a second layer of a $Cr_z$ composition;

wherein no two adjacent layers of metallic compositions are the same; and wherein x, y and z indicate atomic percent; $x+y+z=100$; and $20<x<80$ $5<y<12$ and $25<z<90$.

10. A method for producing a multilayered metal film resistor having an improved TCR and an improved and controllable TCR Slope, wherein said TCR and TCR Slope both approach zero, comprising the steps of:

depositing a first layer of a first metallic composition on an insulative substrate and heating the same at a temperature of from about 290° C. to about 350° C. for a period of time sufficient to effect a desired TCR;

depositing a second layer of a second metallic composition on and coextensive with said first composition and heating said layers at temperature of from about 290° C. to about 350° C. for a period of time sufficient to effect a desired TCR for said layer; and optionally, depositing a plurality of said metallic compositions to form alternately differing metallic layers.

* * * * *